US007394187B2

(12) United States Patent
White et al.

(10) Patent No.: US 7,394,187 B2
(45) Date of Patent: Jul. 1, 2008

(54) ELECTRON MULTIPLIERS AND RADIATION DETECTORS

(75) Inventors: P. Brian White, Palmer, MA (US); Paul L. White, Sturbridge, MA (US); R. Gregory Downing, Niskayuna, NY (US); W. Bruce Feller, Tolland, CT (US)

(73) Assignee: Nova Scientific, Inc., Sturbridge, MA (US)

( * ) Notice: Subject to any disclaimer, the term of this patent is extended or adjusted under 35 U.S.C. 154(b) by 557 days.

(21) Appl. No.: 10/995,833

(22) Filed: Nov. 23, 2004

(65) Prior Publication Data

US 2005/0093410 A1 May 5, 2005

Related U.S. Application Data

(63) Continuation of application No. 10/138,854, filed on May 3, 2002, now Pat. No. 6,828,714.

(51) Int. Cl.
*H01J 43/00* (2006.01)

(52) U.S. Cl. ..... 313/103 R; 313/528; 313/103 CM; 313/105 CM; 313/379; 250/207

(58) Field of Classification Search ..... 313/103 R, 313/103 CM, 105 CM, 104, 379, 528, 523, 313/531–534; 250/207
See application file for complete search history.

(56) References Cited

U.S. PATENT DOCUMENTS 3,603,828 A 9/1971 Sheldon ..... 313/527
3,634,713 A 1/1972 Foote ..... 313/103 R
3,939,374 A 2/1976 Schagen et al. ..... 313/534
5,086,248 A 2/1992 Horton et al. ..... 313/103 CM
5,378,960 A * 1/1995 Tasker et al. ..... 313/103 CM
5,391,101 A 2/1995 Aebi et al. ..... 445/50
5,493,111 A 2/1996 Wheeler et al. ..... 250/207
5,565,729 A 10/1996 Faris et al. ..... 313/103 CM
5,568,013 A 10/1996 Then et al. ..... 313/532
5,656,807 A * 8/1997 Packard ..... 250/214 VT
5,939,613 A 8/1999 Naaman et al. ..... 313/400 X
6,384,519 B1 5/2002 Beetz, Jr. et al. ..... 313/103 CM
7,183,701 B2 * 2/2007 Downing et al. ..... 313/103 R

OTHER PUBLICATIONS

"A Silicon Based Microchannel Plate Converter Screen and Image Intensifier for Fast Neutron Imaging with Amorphorous Silicon or Selenium Large Area Detector Arrays", University of Leiceister, Microchannel Plate Group, www.src.le.ac.uk/mcp/neutron.html, updated Jul. 2001.
"MCP Optics", University of Leiceister, Microchannel Plate Group, www.src.le.ac.uk/mcp/optics/mcp-optics.html, updated Jul. 2001.

(Continued)

*Primary Examiner*—Haissa Philogene
(74) *Attorney, Agent, or Firm*—Fish & Richardson P.C.

(57) ABSTRACT

An electron multiplier includes a plate having a plurality of interconnected particles, e.g., fibers, having electron-emissive surfaces. The particles may include a neutron-sensitive and/or neutron reactive material, such as $^{6}$Li, $^{10}$B, $^{155}$Gd, $^{157}$Gd,—and/or hydrogenous compounds, in excess of their natural abundance. The particles may include an X-ray sensitive and/or X-ray reactive material, such as Pb.

27 Claims, 7 Drawing Sheets

OTHER PUBLICATIONS

"Microchannel Plate", Photonics Products, New Product Announcements, www.photonics.com/Spectra/NewProds/apr01/dPlate.html, Apr. 2001.

"Technical Brief, #1-Dynamic Range", Scientific Detector Products Technical Briefs, Burle Industries, Inc., www.burle.com/dettechbrief_1.htm, 2001.

"Microchannel Plate Imaging Neutron Detector", Nova Scientific, Inc., www.bmdotechnology.net/techsearch.asp?articleid=515, 2000-2001.

Ron Naaman, "An electron multiplier capable of working at low vacuum: The microsphere plate", Rev. sci. Instrum, 67 (9), Sep. 1996.

"Longscale Microchannelplate F6492", Hamamatsu, 1997.

"Ion Detectors", Scimedia:Ion Detectors, http://elchem.kaist.ac.kr/vt/chem-ed/ms/detector/detector.htm 1996.

Tremsin et al., "The Microsphere Plate: a new type of electron multiplier", Nuclear Instruments and Methods in Physics Research A. 368 (1996) 719-730.

"The Micro Sphere Plate: A novel electron multiplier", El-Mul Technologies, Nuclear Instruments and Methods in Physics Research, Section A, vol. 368, No. 3, p. 719-30, Jan. 11, 1996.

Joseph Ladislas Wiza, "Microchannel Plae Detectors", Nuclear Instruments and Methods, vol. 162, 1979, pp. 587-601.

Fraser et al., "Thermal neutron imaging using microchannel plates", Neutrons, X-rays and Gamma Rays: Imaging Detectors, Materials Characterization Techniques and Applications, Spie Proceedings, vol. 1737, Jul. 21-22, 1992, San Diego, CA.

"Microchannel Plate (MCP)" www.hpk.co.jp/eng/products/Etd/MCPE.htm, retrieved Jan. 9, 2002.

"Microchannel Plate Imaging Detectors", www.nasatech.com/ITB/Fr/T7_330.html, retrieved Jan. 9, 2002.

"Microchannel Plate Principles of Operation", http://hea-www.harvard.edu/HRC/mcp/mcp.html, retrieved Jan. 9, 2002.

Greg Downing et al., "Neutron Detection and Imaging using Microsphere Plates", Nova Scientific, Inc., Jun. 20, 2001.

El-Mul Technologies, http://el-mul.co.il, retrieved Jun. 23, 1999.

MicroSphere Plates, www.tectra.de/e/detect.htm. update Sep. 28, 1999.

Bradley, Peter, D., "The development of a Novel Silicon Microdosimeter for High LET Radiation Therapy", University of Wollongong, Department of Engineering Physics, 2000.

PCT International Search Report dated Mar. 23, 2004 (3 pages).

* cited by examiner

ELECTRON MULTIPLIERS AND RADIATION DETECTORS

CROSS-REFERENCE TO RELATED APPLICATIONS

This application is a continuation application of and claims priority to U.S. application Ser. No. 10/138,854, filed on May 3, 2002 now U.S. Pat. No. 6,828,714, hereby incorporated by reference in its entirety.

TECHNICAL FIELD

The invention relates to electron multipliers and radiation detectors.

BACKGROUND

An electron multiplier can be formed by bonding a perforated or porous plate, e.g., a lead glass plate, between an input electrode and an output electrode, and providing a high voltage direct current (DC) field between the electrodes. When incident particles, such as electrons, ions, or photons, strike the input electrode and collide against glass surfaces within the plate, electrons, sometimes called "secondary electrons", are produced. The secondary electrons are accelerated by the DC field toward the output electrode, and collide against other surfaces within the plate to produce more secondary electrons, which can in turn produce more electrons as they accelerate through the plate. As a result, an electron cascade or avalanche can be produced as the secondary electrons accelerate through the plate and collide against more surfaces, with each collision capable of increasing the number of secondary electrons. A relatively strong electron pulse can be detected at an output face.

Electron multipliers commonly include two types of plates: microchannel plates (MCPs) and microsphere plates (MSPs). Microchannel plates (MCPs) typically include a glass plate perforated with a regular, parallel array of microscopic channels, e.g., cylindrical and hollow channels. Each channel, which can serve as an independent electron multiplier, has an inner wall surface formed of a semi-conductive and electron emissive layer. As incident particles enter a channel and collide against the wall surface to produce secondary electrons, a cascade of electrons can be formed as the secondary electrons accelerate along the channel (due to the DC field), and collide against the wall surface farther along the channel, thereby increasing the number of secondary electrons.

Microsphere plates (MSPs) typically include a glass plate formed of microscopic glass spheres that have semi-conductive and electron emissive surfaces. The spheres are packed and bonded together, e.g., by compression and sintering. As incident particles collide against the surfaces of the spheres to form secondary electrons, a cascade of electrons can be formed as the secondary electrons accelerate through the interstices defined by the spheres and collide against the surfaces of other spheres.

SUMMARY

The invention relates to electron multipliers and radiation detectors.

In one aspect, the invention features an electron multiplier including a plate having a plurality of interconnected fibers having electron-emissive surfaces.

Embodiments may include one or more of the following features. The fibers include a glass having lead. The fibers include a neutron-sensitive material. The neutron-sensitive material is selected from a group consisting of $^{6}Li$, $^{10}B$, $^{155}Gd$, and $^{157}Gd$ in excess of their natural abundance. The fibers include a hydrogen-containing material. The fibers have a length to width aspect ratio of about 50:1 to about 3,000:1, although higher aspect ratios are possible. The plate has a void volume percentage between about 25% and about 90%. The fibers have a first region having a first lead concentration, and a second region having a second lead concentration greater than the first lead concentration. The first region is between the second region and the surfaces of the fibers.

In another aspect, the invention features an electron multiplier including a plate having interconnected particles having material selected from a group consisting of $^{6}Li$, $^{10}B$, $^{155}Gd$, $^{157}Gd$, in excess of their natural abundance, Pb, and a hydrogen-containing material.

Embodiments may include one or more of the following features. The particles include glass having lead. The glass and the material are intimately mixed. The particles include spheres and/or shards. The particles include a core, e.g., substantially spherical, of the material. The core is surrounded by a layer of glass. The layer of glass includes a neutron-sensitive material selected from a group consisting of $^{6}Li$, $^{10}B$, $^{155}Gd$, and $^{157}Gd$ in excess of their natural abundance. The material is dispersed within the particles.

In another aspect, the invention features a neutron-sensitive particle including a core having a material selected from a group consisting of $^{6}Li$, $^{10}B$, $^{155}Gd$, $^{157}Gd$, in excess of their natural abundance, Pb, and a hydrogen-containing material; and a glass portion surrounding the core.

Embodiments may include one or more of the following features. The core is substantially spherical. The glass portion includes lead. The glass portion has a first region having a first lead concentration, and a second region having a second lead concentration greater than the first lead concentration. The first region is between the second region and an outer surface of the glass portion.

In another aspect, the invention features an electron multiplier including a plate having an array of channels; and a plurality of interconnected particles in at least one channel.

Embodiments may include one or more of the following features. The particles fill a portion of the channel. The plate includes a glass having lead. The particles include fibers, shards, and/or spheres. The particles have an electron-emissive surface layer. The channels have an electron-emissive surface layer. The particles include a neutron-sensitive material selected from a group consisting of $^{6}Li$, $^{10}B$, $^{155}Gd$, and $^{157}Gd$ in excess of their natural abundance. The particles include a hydrogen-containing material. The particles include a core of the neutron-sensitive material. The core is substantially spherical. The channels have different widths along their lengths. The particles extend flushed to a surface of the plate. The particles further cover at least a portion of a surface of the plate different than a surface of the channel. The multiplier further includes an electrode covering a portion of the plate and the particles.

In another aspect, the invention features an X-ray sensitive particle including a core comprising lead and a glass portion surrounding the core. The glass portion can include lead. The core can be substantially cylindrical or spherical. The particle can be in the form of a fiber, a sphere, or a shard. The particle can be incorporated in multipliers and detectors described herein.

Embodiments may include one or more of the following advantages. The plates can have good mechanical properties, such as relatively good rigidity and/or toughness. The plates can be used in a neutron detector or a neutron imager to provide efficient neutron detection and good spatial resolution, e.g., sub-millimeter resolution. The plates can be used in a hard X-ray (>10 keV) detector or imager to provide efficient hard X-ray detection and good spatial resolution, e.g., sub-millimeter resolution. The plates can be fabricated into very large area formats, e.g., larger than a square meter. The plates can be curved or shaped to match focal plane requirements.

Other features, aspects, and advantages of the invention are in the description, drawings, and claims.

DETAILED DESCRIPTION

Figure 1:
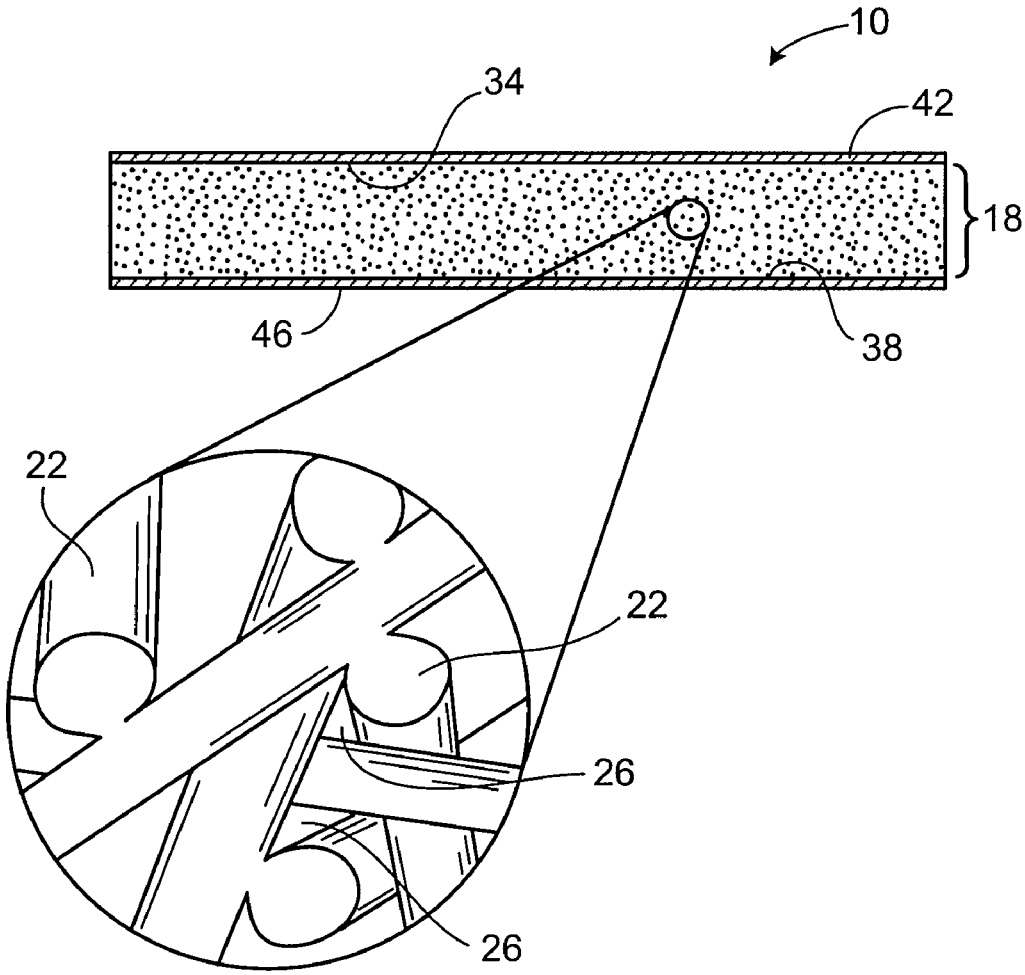
FIG. 1 is a cross-sectional view of an embodiment of an electron multiplier.

Referring to FIG. 1, an electron multiplier 10 includes a plate 18 having an input side 34 and an output side 38, an input electrode 42 bonded to the input side, and an output electrode 46 bonded to the output side. Electrodes 42 and 46 are configured to provide a DC field (here, across plate 18 and generally normal to the electrodes) to accelerate secondary electrons toward output electrode 46. Plate 18 is formed of fibers 22 that interconnect to form a complex network structure having interstices or passages 26 that typically extend between electrodes 42 and 46. Fibers 22 can be, e.g., lead glass or lead glass-coated fibers having semi-conductive and electron-emissive surfaces. As shown, portions of fibers 22 have been fused to other fibers, for example, by heating the fibers such that areas where the fibers contact each other soften, intermix, and fuse upon cooling. Portions of fibers 22 not fused to other fibers remain exposed, e.g., to a vacuum or ambient atmosphere.

During use, incident particles, such as photons, atoms, molecules, electrons, ions, or neutrons interact and react with fibers 22 within plate 18, preferably but not exclusively near input electrode 42, and produce secondary electrons. The secondary electrons, accelerated toward output electrode 46 by an applied DC field, collide against the surfaces of other fibers as they travel through plate 18, and produce more secondary electrons. As a result, an electron cascade is created, with a relatively large number of electrons exiting plate 18.

Without wishing to be bound by theory, it is believed that fibers 22 define a multitude of partially obstructed pathways through plate 18 that enhances electron multiplication while improving uniformity of the electron cascade across the plate. As illustrated in FIG. 1, the axes of fibers 22 are arranged at angles, for example, a multitude of angles or random angles. In some embodiments, the pathways and obstructions of the pathways are such as to provide no line of sight normal to the plate, and/or to create an interconnecting network of continuous and meandering openings through plate 18. In comparison to random angles, a regular or repeating pattern, such as in a weave, may also be used. The multiple interconnections between fibers help to provide multiple pathways through which electrons may flow to replenish electrons lost through the production of electron cascade events in the device. Furthermore, the multiple interconnections between multiple fibers help to maintain a uniform electrical current between input and output electrodes 42 and 46, thereby increasing, e.g., maximizing, the flow of the electron cascade event in a direction perpendicular to the faces of the electrode. Consequently, physical obstructions and electrical repulsive forces broaden the electron cascade as it migrates from the origin of the cascading event to output electrode 46.

Fibers 22 are generally elongated structures having lengths greater than widths or diameters. Fibers 22 can have a length of about 0.1 mm to about 50 mm. In some embodiments, fibers 22 can have a length greater than about 0.1 mm, 0.5 mm, 1 mm, 5 mm, 10 mm, 15 mm, 20 mm, 25 mm, 30 mm, 35 mm, 40 mm, or 45 mm; and/or less than about 50 mm, 45 mm, 40 mm, 35 mm, 30 mm, 25 mm, 20 mm, 15 mm, 10 mm, 5 mm, 1 mm, or 0.05 mm. The lengths of fibers 22 may be uniform or relatively random. For example, a 20-micron diameter fiber can include one or more lengths from about 0.3 mm to 10 mm in length. Relatively long fibers 22 can be used for large plates 18, but relatively short fibers may provide resistance to coiling and a uniform plate. In some embodiments, fibers of long, continuous lengths can be loosely weaved to provide uniform and large plates, as in fiberglass cloth loom processing known in the fiberglass industry. Fiber 22 can be a width of about 0.3 to 100 microns although other widths are possible in other embodiments, e.g., where the glass composition is modified as discussed below. Fibers 22 can have a width greater than about 0.3, 1, 5, 10, 15, 20, 25, 30, 35, 40, 45, 50, 55, 60, 65, 70, 75, 80, 85, 90, or 95 microns; and/or less than about 95, 90, 85, 80, 75, 70, 65, 60, 55, 50, 45, 40, 35, 30, 25, 20, 15, 10, 5, or 1 micron. The width can be uniform or relatively random.

In some embodiments, fibers 22 have length to width aspect ratios from about 50:1 to about 3,000:1, although higher aspect ratios are possible. In some embodiments, the length to width aspect ratios can be greater than about 50:1, 100:1, 500:1, 1,000:1, 1,500:1, 2,000:1, or 2,500:1; and/or less than about 3,000:1, 2,500:1, 2,000:1, 1,500:1, 1,000:1, 500:1, or 100:1. The width used to determine the aspect ratio can be the narrowest or broadest width. The length can be the largest dimension of a fiber. Mixtures of fibers having two or more different aspect ratios and/or dimensions can be used in plate 18.

Fibers 22 can have a variety of configurations or shapes. Fibers 22 can have a cross section that is circular or non-circular, such as oval, or regularly or irregularly polygonal having 3, 4, 5, 6, 7, or 8 or more sides. The outer surface of fibers 22 can be relatively smooth, e.g., cylindrical or rod-like, or faceted. Fibers 22 can have uniform or non-uniform thickness, e.g., the fibers can taper along their lengths. Mixtures of fibers having two or more different configurations or shapes can be used in plate 18. In other embodiments, thin, flat shard-like fibers having irregular shapes can be used. Spherical particles can be combined with fibers 22.

Fibers 22 typically include glass combined with lead, e.g., in the form of at least 20 weight percent lead oxide. Other semiconducting glasses may also be used, e.g., iron borates or bulk conducting vanadate phosphates.

Fibers 22 preferably have a surface that is semi-conductive and electron-emissive. In certain embodiments, lead glass fibers can be heated in a reducing atmosphere, e.g., hydrogen, to form the semi-conductive and electron-emissive surface on the fibers. Without wishing to be bound by theory, it is believed that this reduction step produces a first region adjacent to the surface of fibers 22 that is relatively depleted of or poor in lead, and a second region farther away from the surface of the fibers that is relatively enriched or locally elevated with lead. The lead concentrations as described are relative to the average lead concentration of unreduced lead glass fibers. It is believed that the semi-conductive and electron-emissive surface layer extends to about 200 nanometers from the surface of the fibers. Fibers 22 can also have a surface coating of reducible lead glass, with a core of a neutron sensitive material.

Fibers 22 are assembled relatively randomly within plate 18, e.g., the fibers may be stacked and cross randomly, to form a network structure. Fibers 22 may also stack or be weaved into a regular pattern, also forming a network structure. In some embodiments, plate 18 can have a void volume percentage of about 25% to about 90%, e.g., greater than about 25%, 30%, 35%, 40%, 45%, 50%, 55%, 60%, 65%, 70%, 75%, 80%, or 85% and/or less than about 85%, 80%, 75%, 70%, 65%, 60%, 55%, 50%, 45%, 40%, 35%, or 30%. The microscopic network structure of plate 18 may resemble the microscopic structure of a sponge or of cancellous bone, slightly bonded felt, or three-dimensional layers of netting.

Plate 18 can be formed by placing fibers 22 in a liquid carrier, allowing the fibers to fall on a substrate, and drying the fibers to form a flexible mat. The liquid carrier can be, e.g., a solution having properties of specific densities, pH, viscosities or other characteristic to facilitate the uniform distribution of fibers. The substrate can be, e.g., a porous or adsorbent surface such that the liquid can be removed with minimal disturbance to the distribution of the fibers. In other embodiments, fibers 22 are mixed with a binder, e.g., amyl acetate or collodion (a nitrocellulose) in about a 90:10 ratio by weight, and the mixture is pressed in a die and collar set using an anvil press to form a mat. Pressures of up to 25,000 psi can be used to form a mat that is strong and can be handled. Either method can produce a thick mat of fibers 22, e.g., about 0.3 to 5 mm, that has a low density, e.g., about 40-60% of the solid glass density.

A load is then placed on top of the mat of fibers 22. The loaded mat is placed into a controlled atmosphere furnace and heated at a relatively low temperature, e.g., about 175° C., for about 60 min, in air or oxygen to remove the binder (or carrier) from the mat while preserving the structural integrity of the mat. Subsequently, the mat is heated at a higher temperature, such as the softening temperature of fibers 22, e.g., about 675° C., for about 4 hr. While generally retaining their structural integrity, fibers 22 fuse together where they touch or are in close proximity to form a plate 18. In embodiments, the density of plate 18 after heating is about 1.5 to about 2.5 g/cc. In some cases, a mechanical stop or shim can be used to control the final desired dimensions and/or density.

After fibers 22 are fused, plate 18 is heated in a reducing atmosphere, e.g., hydrogen, to form the semi-conductive and electron-emissive surface layer on the fibers. For example, plate 18 can be heated at 525° C. for about 16 hr. The conditions used to form plate 18, such as temperatures and times, can be optimized, for example, as a function of the composition and physical properties, e.g., lead oxide content and glass transition temperature, of fibers 22.

Plate 18 can be formed in a variety of configurations. Plate 18 can be substantially flat, curved, or hemispherical, and of uniform or non-uniform thickness. To form a curved plate, for example, a mat of fibers 22 can be placed on an appropriated-shaped steel mold, and heated to soften the mat, thereby allowing the mat to conform to the mold. A load may be placed on the mat to help the mat conform to the mold. Plate 18 can be circular or non-circular, e.g., oval, or regularly or irregularly polygonal having 3, 4, 5, 6, 7, or 8 or more sides. In some embodiments, plate 18 can include cutouts and/or holes. Plate 18 can have a thickness of, for example, from about 0.2 mm to about 5 mm. Plate 18 can be formed greater than, e.g., 10 cm×10 cm.

After plate 18 is formed, electrodes 42 and 46 are formed on input and output sides 34 and 38, respectively. Electrodes 42 and 46 are typically layers of conductive materials, vacuum deposited by evaporation or sputtering and using fixtures. Suitable materials for electrodes 42 and 46 include, for example, Nichrome™ (a Ni—Cr alloy) and gold. Different materials may be used to form electrodes 42 and 46. Electrodes 42 and 46 can cover substantially all or a portion of input and output sides 34 and 38, respectively. In some embodiments, electrodes 42 and 46 have a thickness of about 1000 Angstroms to about 3000 Angstroms. The thickness can be uniform or non-uniform, and the thickness of electrodes 42 and 46 can be the same or different.

Figure 2:
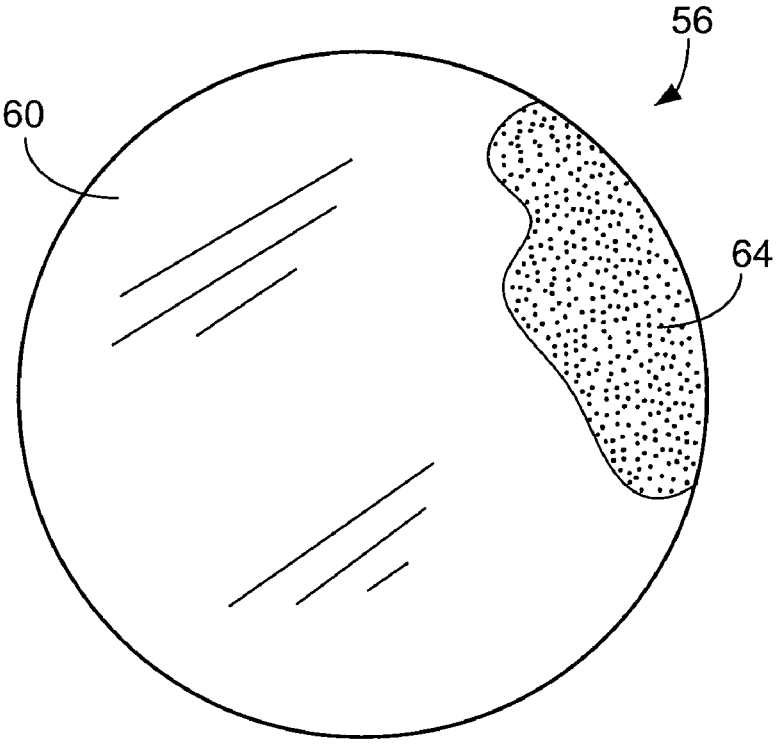
FIG. 2 is a top view of an embodiment of an electron multiplier.
Figure 3:
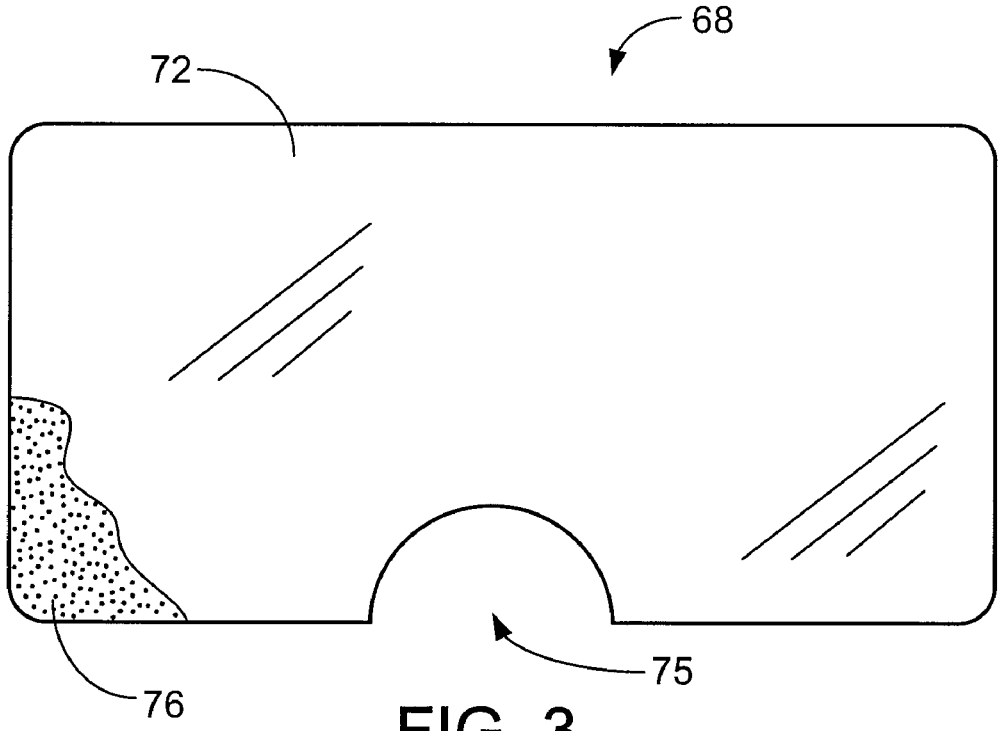
FIG. 3 is a top view of an embodiment of an electron multiplier.
Figure 4:
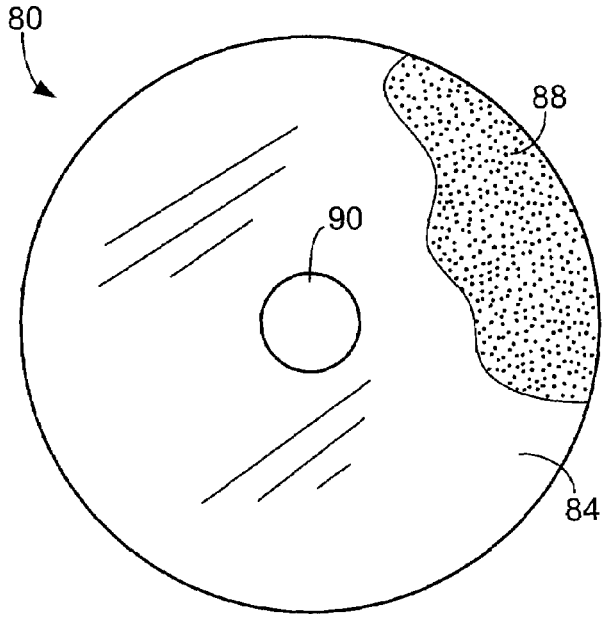
FIG. 4 is a top view of an embodiment of an electron multiplier.

Referring to FIGS. 2-4, embodiments of electron multipliers are shown. FIG. 2 shows a flat and circular electron multiplier 56 having a plate 64 and an electrode 60 covering the plate. FIG. 3 shows a flat and irregularly shaped electron multiplier 68 having a plate 76, an electrode 72 covering the plate, and notch 75 in the side of the multiplier. Electron multiplier 68 is capable of functioning as a scattering detector, e.g., when a beam of incident particles is parallel to the detector. Notch 75 allows the beam of radiation to pass by the device without directly interacting with it. Radiation particles not coherent with the beam can stray wider than notch 75 and can be detected. Likewise, radiation particles that scatter from interactions on the back side of multiplier 68 can scatter back into the multiplier and be detected. FIG. 4 shows a circular and flat electron multiplier 80 having a plate 88, an electrode 84 covering the plate, and a circular hole 90 at the center of the multiplier. Electron multiplier 80 is capable of allowing a primary beam of radiation, e.g., photons, electrons, neutrons, atoms, molecules, and/or ions to pass through hole 90 to strike a target, while electron multiplier 80 detects back-scattered primary particles and secondary particles. Hole 90 allows a beam of radiation to pass by the device without directly interacting with it. Radiation particles not coherent with the beam can stray wider than hole 90 and be detected. Likewise, radiation particles that scatter from interactions on the back side of multiplier 80 can scatter back into the multiplier and be detected.

Figure 5:
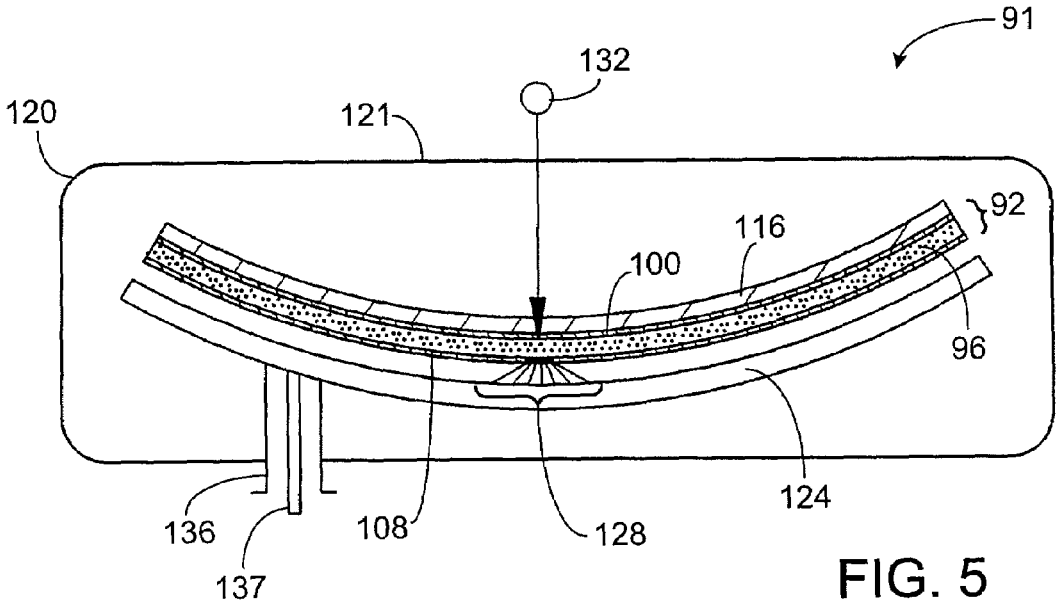
FIG. 5 is a cross-sectional view of an embodiment of an electron multiplier.

FIG. 5 shows a detector 91 having a housing 120, a curved electron multiplier 92, and an electronic readout 124, both enclosed by the housing. Electron multiplier 92 includes a plate 96, e.g., about 2 mm to about 5 mm thick, bonded to an input electrode 100 and an output electrode 108, as described above. Electron multiplier 92 further includes a curved support 116 connected to input electrode 100 to provide enhanced mechanical support for the multiplier. Housing 120 is capable of maintaining a vacuum and includes a window 121 that is relatively non-reactive, e.g., transparent, to particles 132, such as photons, electrons and neutrons, incident on input electrode 100.

Electronic readout 124 is configured to receive and detect secondary electrons 128 that emerge from output electrode 108 as a result of an electron cascade triggered by incident particles 132. Electronic readout 124, which is shaped to closely match the shape of output electrode 108, is spaced but close to the output electrode. A channel 136, which can be sealed to maintain a vacuum in housing 120, provides an aperture to allow electrical lines 137 to pass from electronic readout 124 (and high voltage electrodes 100, 108) to outside connections, such as to high voltage power supplies and appropriate readout electronics.

Support 116 can be made of a material, such as aluminum, sapphire, Kapton™, and be about 0.1-5 mm thick. Housing 120 can be made of a material, such as aluminum, and window 121 can be made, for example, of aluminum oxide. In other embodiments, electron multiplier 92 is hemispherical or cylindrical.

Plates 64, 76, 88, 96, and their corresponding electrodes, including their methods of manufacture, can be generally the same as plate 18 and electrodes 42 and 46, including their methods of manufacture.

OTHER EMBODIMENTS

In other embodiments, an electron multiplier includes a plate having particles containing at least one neutron-sensitive material that enhances the particles' sensitivity to neutrons, e.g., thermal neutrons. The neutron-sensitive material can be intimately mixed with the material(s) of the particles, and/or the neutron-sensitive material can form one or more discrete portion of the particles. The electron multiplier can be used, for example, in neutron detection and/or neutron imaging.

Figure 6:
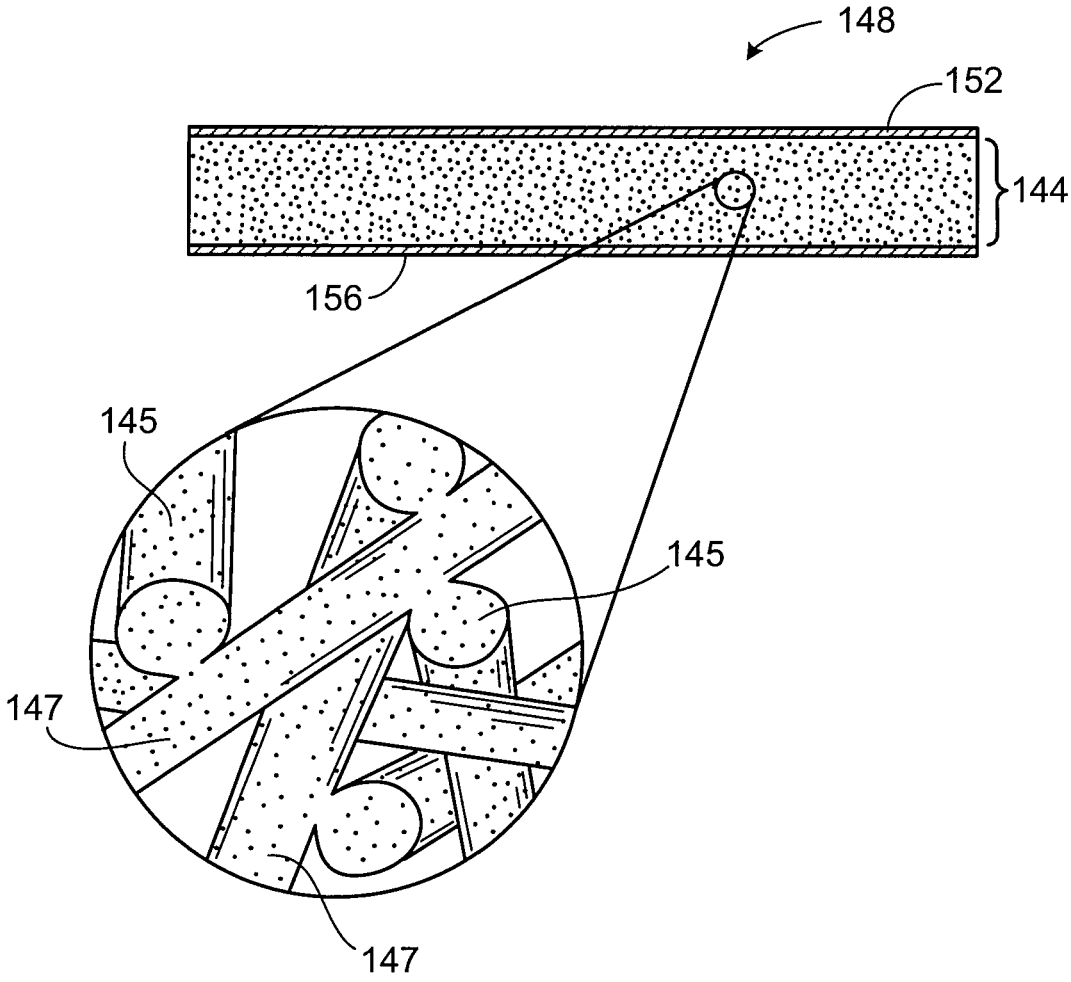
FIG. 6 is a cross-sectional view of an embodiment of an electron multiplier.

Referring to FIG. 6, an electron multiplier 148 includes a plate 144 formed of interconnected particles 145 mixed with at least one neutron-sensitive material 147. Plate 144 is attached to an input electrode 152 and an output 156. Particles 145, e.g., fused lead glass particles, can be fibers (as described above), spheres, shards, or a combination of differently shaped particles. Neutron-sensitive material 147 can be, for example, $^{6}$Li, $^{10}$B, $^{155}$Gd, $^{157}$Gd, or mixtures of these materials, in excess of their natural abundance. When used in excess of their natural abundance, material 147 can enhance the neutron detection efficiency of particles 145, e.g., compared to the material in its natural abundance.

During use, as incident neutrons penetrate input electrode 152 and particles 145, and react with neutron-sensitive material 147, reaction products are produced, e.g., photons, charged or uncharged particles (such as $^{3}$H, $^{4}$He, $^{3}$He, or $^{7}$Li) or beta particles (such as electrons in the case of $^{155}$Gd or $^{157}$Gd). When hydrogen-containing material, such as high-density polyethylene, Nylon™, or polyaramid is incorporated into plate 144, neutron radiation can release energetic protons within the plate and produce secondary electrons. When the site of the reaction or interaction is sufficiently close to the surface of a particle (e.g., a lead glass fiber having an electron-emissive surface), the reaction products escape through the electron emissive surface layer of the particle and cause an emission of secondary electrons. When a beta particle escapes from a particle and collide against another particle, the collision can trigger the release of secondary electrons. A cascade of electrons can be produced and detected, as described above.

Accordingly, particles 145 are preferably sized to enhance the probability that an alpha or beta particle can escape from the particles. In embodiments in which particles 145 include spheres having 6Li or $^{10}$B, the spheres can have a diameter about 10 microns to about 100 microns, e.g., 25 microns to about 50 microns. Preferably, particles 145 are relatively small to enhance alpha or beta particle escape, while the interstitial spacing of the particles is relatively large to enhance electron multiplication. In embodiments in which particles 145 include fibers having $^{6}$Li or $^{10}$B, the fibers can have a width (narrowest or widest) as described above for sphere diameters, e.g., about 10 microns to about 100 microns. Similarly, when particles 145 include shards having $^{6}$Li or $^{10}$B, the shards can have a largest dimension as described above for sphere diameters, e.g., about 10 microns to about 100 microns. In some embodiments, the spheres, fibers, or shards are hollow, which may enhance alpha or beta particle escape from the interior.

In embodiments in which particles 145 include spheres having $^{155}$Gd or $^{157}$Gd, the spheres can have a diameter as described above for spheres, fibers and chards, e.g., diameters up to about 200 microns. The spheres can have a diameter greater than about 25, 50, 60, 75, 100, 125, 150, or 175 microns, and/or less than about 200, 175, 150, 125, 100, 75, 60, or 50 microns. In embodiments in which particles 145 include fibers having $^{155}$Gd or $^{157}$Gd, the fibers can have a width (narrowest or widest) as described above for sphere diameter, e.g., up to 200 microns. Similarly, when particles 145 include shards having $^{155}$Gd or $^{157}$Gd, the shards can have a largest dimension as described above for sphere diameters, e.g., up to 200 microns.

Typically, relatively smaller sphere diameters, fiber widths, or shard dimensions enhance the probability that an alpha particle or a beta particle can escape. However, for the electron multiplication process to proceed through plate 144, the inter-particle passages are preferably sufficiently open and spaced to allow a relatively large number of electrons to flow. Relatively open and spaced passages can also enhance plate 144 mechanically. The passages can also enhance plate 144 electrically, allowing relatively strong electric field gradients to be supported, allowing relatively high secondary electron energies to be attained, and/or leading to effective electron multiplication. Fused particles, such as spheres, fibers, particulate plates, or shards, that are too small may constrict the inter-particle passages into dead ends or into openings too small to support electron multiplication, e.g., the electrons are unable to attain a sufficient energy at impact to create additional secondary electrons. For example, small particulate plates, which can have geometries that protrude or bow into a passage, can render the passage relatively narrow. Thus, there is a balance between enhancing the dimensions of particles 145 for neutron detection and enhancing the dimensions for electron multiplication.

Particles 145 can be formed by glass processing procedures. Shards can be formed by breaking relatively large pieces of glass into progressively smaller pieces, for example, by hammering, grinding, and/or crushing the glass in a mortar and pestle, and sieving with standard screens to the desired sizes. Filtering processes can screen out excessively large and/or excessively fine particles to obtain shards of a desired size. Size differences can be controlled to within about 7-10 microns. Spheres can be formed by taking the sized shards and further processing them through a high temperature flame, which makes the shards spherical. The resultant spheres are then sieved again to the desired sizes. Fibers can be made by heating a cylindrical preform in a high temperature furnace and pulling a small diameter fiber from the heated glass cylinder. The diameter of the fiber can be controlled, e.g., by controlling the speed of fiber pull and the temperature of the furnace. A small diameter fiber can be wound onto a drum and cut to a desired length.

Particles 145 may include a range of concentrations of neutron-sensitive material 147. In some embodiments, particles 145 includes between about 5% and about 40% by weight of neutron-sensitive material 147, e.g., greater than about 5%, 10%, 15%, 20%, 25%, 30%, or 35%, and/or less than about 40%, 35%, 30%, 25%, 20%, 15%, or 10%.

In some cases, neutron-sensitive material 147 can affect the stability of particles 145, including their glass forming properties, e.g., viscosity, melting temperature, and crystallization properties. Material 147 can also affect the electron multiplication process, e.g., by affecting the ability of particles 145 to form a thin semi-conductive and electron-emissive surface layer. The additions, combinations, and optimization of neutron-sensitive material 147 can be empirically determined through experimentation.

Electron multiplier 148 and plate 144 can be formed and modified as described above for multiplier 10 and plate 18.

Figure 7:
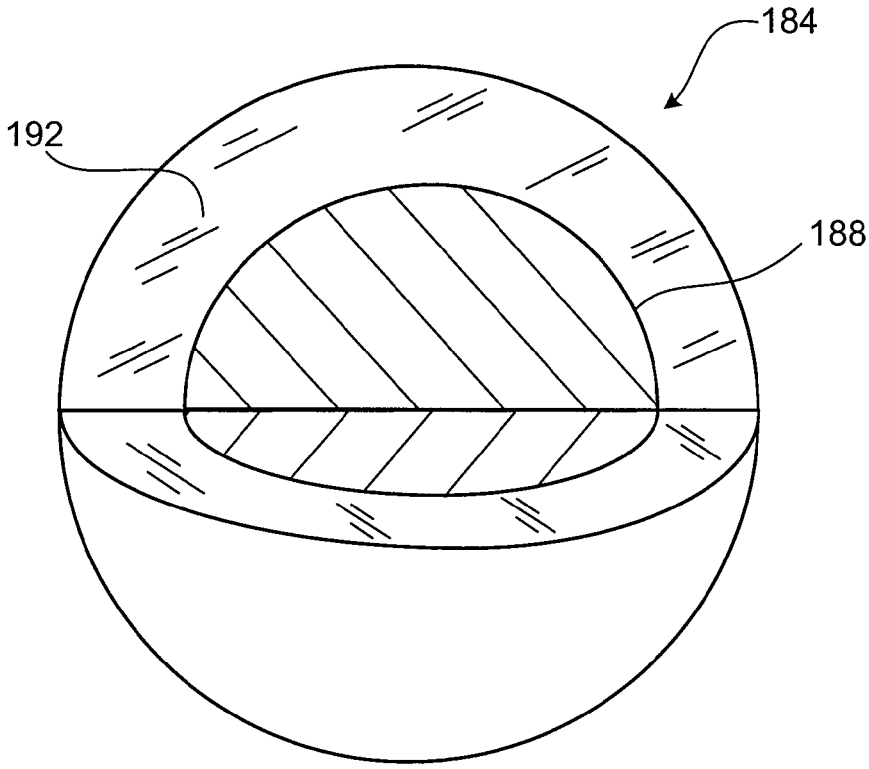
FIG. 7 is a partially cutaway view of a particle.

In other embodiments, neutron-sensitive material 147 forms a discrete portion of a particle, e.g., a lead glass particle. Referring to FIG. 7, a particle 184 (here, a lead glass sphere about 0.5-100 microns in diameter) contains a core 188 of neutron-sensitive material 147. Core 188 is surrounded by a layer 192, e.g., lead glass about 0.2-1 microns thick, having a semi-conductive and electron-emissive surface layer. Particle 184 can be a fiber, a sphere, a shard, or a particulate plate.

The chemical composition of the fiber, sphere, or chard may be varied according to distance from the outer surface of the particle. By decreasing the amount of neutron-sensitive material at depths where neutron-induced reaction products (charged particles, neutrals, and electrons) would be unable to escape to the surface and where such depths exceed the range of these reaction products, a chemical gradient is formed within the particle. Establishing this gradient or preferential layer enriched in neutron-sensitive material can increase the neutron detection efficiency of a detector by preventing neutrons from being absorbed at depths in the particle where they may not be effective and where the reaction products may be unable to escape and thus not contribute to the detection process. This can effectively increase the number of neutrons passing through the particle and increase e the probability of such surviving neutrons interacting with other particles. The percentage of neutrons interacting with a given particle that yield a reaction product that escapes the particle to form an avalanche may also be increased.

A preferred radius of core 188 is approximately the distance traveled by a neutron-induced particle, but less than the distance of the layer 192. The thickness of core 188 can be greater of less than the distance traveled by the neutron-induced particle. If the size of core 188 is greater than the range of a neutron-induced particle, the effectiveness of the reactions to produce electron cascades can be decreased. If the radius is less than the range of the induced charged particle, the effectiveness of the reaction to produce electron cascades can be increased. If the radius of core 188 is within the range or greater, a chemical gradient of the neutron sensitive material is preferably formed in which the region farthest away from the outer surface of particle 188 and greater than the range of the neutron induced particles is depleted of or reduced in neutron sensitive material.

Layer 192 can have a thickness of several thousand Angstroms. Layer 192 may or may not contain neutron sensitive material. Layer 192 is preferably thick enough to support an electron-emissive layer and an electron conductive layer immediately beneath the electron-emissive layer. The electron conductive layer can replenish electrons lost by the electron-emissive layer. The thickness of layer 192 is typically the same for sphere, fiber, and shard particles. In some embodiments, layer 192 is intimately combined with neutron-sensitive material 147, as described above for particle 145.

Particles 184 having the shape of fibers can be formed by drawing a rod of neutron-sensitive material 147 surrounded by a tube of layer 192, e.g., lead glass having an electron-emissive surface layer. Co-drawing the rod and the tube permits them to fuse into a two-component fiber. The fiber can be processed, e.g., cut to length, as previously described.

Particles 145 and/or 184 can be used in electron multipliers having a variety of configurations, e.g., multipliers 10 and as described below.

Figure 8:
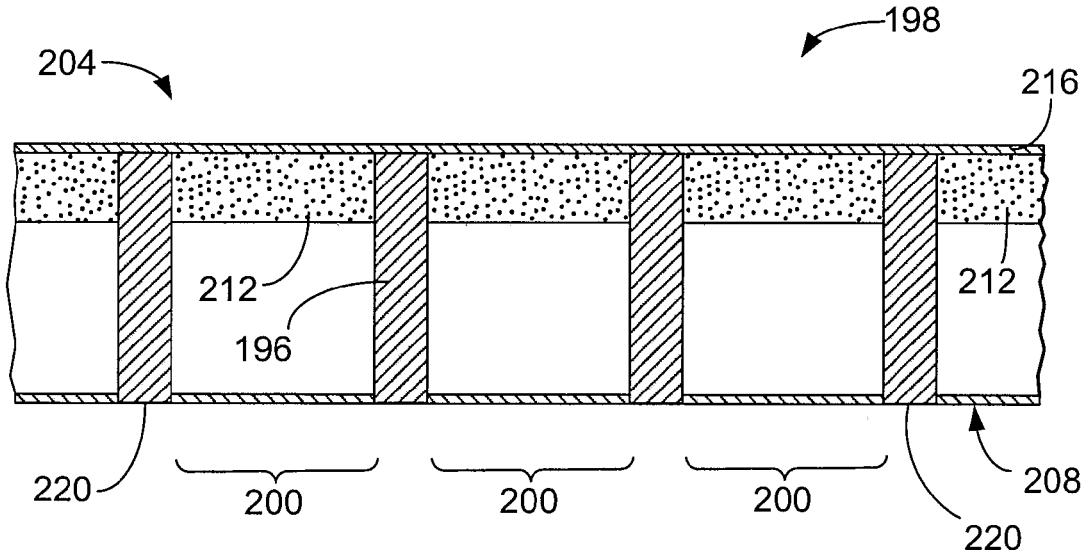
FIG. 8 is a cross-sectional view of an embodiment of a plate.

Referring to FIG. 8, an electron multiplier 198, adapted for neutron detection or neutron imaging applications, includes a plate 196, having a regular array of cylindrical channels 200 oriented normal to an input side 204 and an output side 208 of the plate. Plate 196, e.g., a microchannel plate, is commercially available from Burle Electro Optics, ITT, or Litton. Plate 196, e.g., made of lead glass, includes at least one neutron-sensitive material 147 to enhance the neutron sensitivity of the plate, as described for particles 145. Channels 200 have a surface layer that is semi-conductive and electron emissive, e.g., by reduction under hydrogen. Plate 196 is constructed by filling channels 200 with small diameter particles, e.g., particles 145 and/or 184, in a size ratio of channel diameter to particle diameter, e.g., 5:1. Plate 196 can be processed similarly to commercially available electron multipliers.

Figure 9:
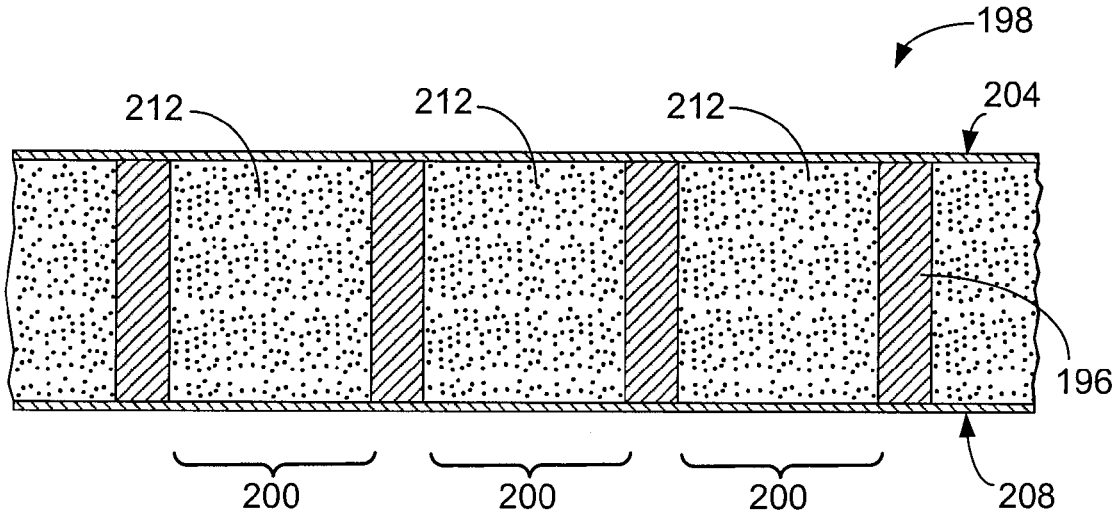
FIG. 9 is a cross-sectional view of an embodiment of a plate.

Electron multiplier 198 further includes particles 212, e.g., lead glass fibers, spheres, or shards that fill a portion of at least one channel 200. Particles 212 can include lead glass, such as that used to enhance an electron cascade, or lead glass containing at least one neutron-sensitive material, such as particles 145 and/or 184. Particles 212 can fill an entire channel 200 (FIG. 9), or a portion of the channel, e.g., less than about 100%, 90%, 80%, 70%, 60%, 50%, 40%, 30%, 20% or 10% of the length of the channel, and/or greater than about 0%, 10%, 20%, 30%, 40%, 50%, 60%, 70%, 80% or 90% of the length of the channel. In embodiments in which multiple or all the channels 200 are blocked with particles 212, the level of blockage can be substantially equal, e.g., for consistent function across the breadth of plate 196. Channels 200 can have different levels of blockage by particles 212. An input electrode 216 covers input side 204 of plate 196 and particles 212 that extend to input side 204; and an output electrode 220 covers output side 208 of plate 196. All or a portion of plate 196 or particles 212 can be covered by input electrode 216 or output electrode 220. For example, input electrode 216 may cover input side 204, with or without covering particles 212 that extend to the input side.

Without wishing to be bound by theory, it is believed that particles 212 in channels 200 perform at least two functions. Particles 212 can reduce the reverse flow of ions back through channels 200, which can reduce spurious noise, increase the gain of electron multiplier 198, and/or allow the multiplier to function at relatively high pressures, e.g., of up to 1 millitorr, compared to channels not having the particles. Particles 212 can also absorb and react with slow neutrons, and permit the products of those reactions to escape from the particles. As a result, secondary electrons can be produced, and an electron cascade can be created within the channel 200. In some embodiments, it is preferable that the electron cascade be triggered as near to input side 208 as possible, so particles with enhanced neutron sensitivity are grouped in channel 200 near the input side.

Furthermore, electron multiplier 198 is capable of providing good resolution because it contains an array of isolated channel electron multipliers. Electron multiplier 198 can also have reduced false activations caused by ions traveling in the reverse direction of the electron cascade. Particles 212 also provide plate 196 with structural support, thereby reducing the fragility of the plate.

Figure 10:
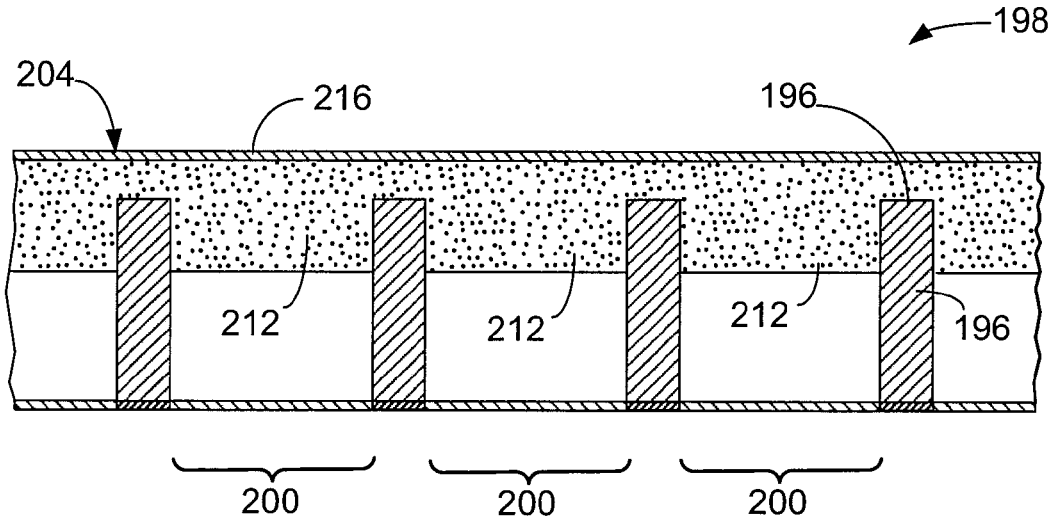
FIG. 10 is a cross-sectional view of an embodiment of a plate.

As shown in FIG. 8, particles 212 fill channel(s) 200 evenly or flushed with input side 204. Referring to FIG. 10, in other embodiments, particles 212 extend past channel(s) 200 and cover input side 204. As a result, an increased number of incident particles and/or secondary electrons may enter channel(s) 200, thereby increasing detection efficiency. Extending particles 212 to cover input side 204 may also simplify manufacture. Particles 212 can cover substantially all or only a portion of input side 204.

Figure 11:
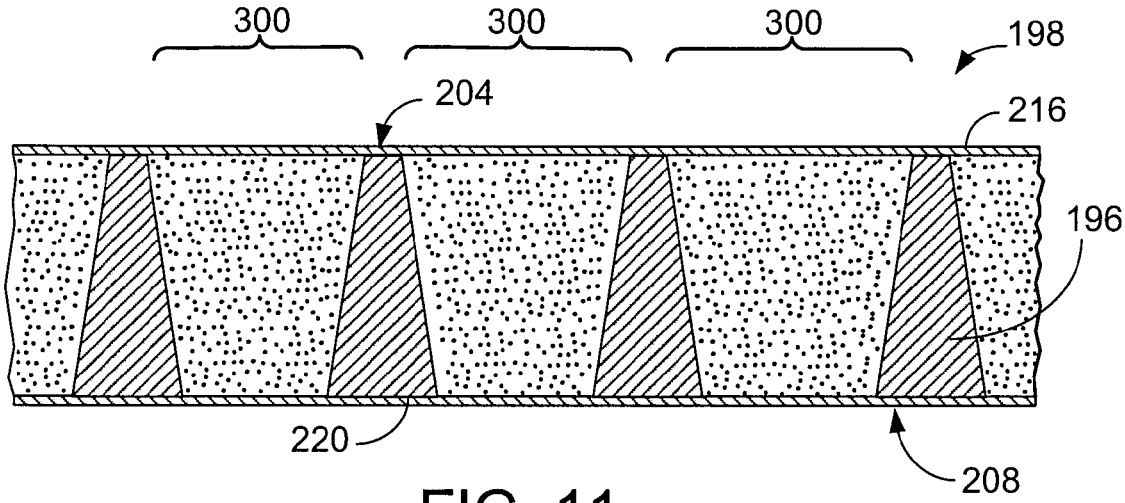
FIG. 11 is a cross-sectional view of an embodiment of a plate.

In certain embodiments, one or more channels 200 have a non-cylindrical shape. Referring to FIG. 11, channels 300 have a frustoconical shape that narrows, e.g., tapers, from input side 204 to output side 208. Channels 200 having frustoconical configurations can be used for expensive or highly configured electronic readouts that are periodically spaced.

Channels 200 can be filled with particles 212 by dispensing loose particles over plate 196, blading the particles into the channels by hand, and subsequently processing the plate as described above (e.g., fusing, reducing, and attaching electrodes). To fix particles 212 at a predetermined height of channel 200 (e.g., the top ⅓ of the channel), the channel can be first loaded with a small non-fusing ceramic powder, such as $Al_2O_3$ or $SiO_2$ (here, in the bottom ⅔ of the channel). The remaining portion of channel 200 (here, the top ⅓) can be topped off with particles 212. Plate 196 can then be heated to fuse particles 212. The non-fusing ceramic powder remain unfused and can be removed after heating, leaving particles 212 fused in channel 200. In other embodiments, rather than using loose particles, a paste including particles 212 can be used.

Particles 212 may include spheres, shards or fibers of standard lead glass, with no enhancement as to neutron sensitivity, and having semi-conductive and electron-emissive surface layers. In other embodiments, to absorb and react with neutrons, particles 212 may include a "core" of neutron-sensitive material, e.g., as described above for particle 184. Alternatively or in addition, particles 212 may include neutron-sensitive material 147 in the material of the particles, as described above for particles 145.

Figure 12:
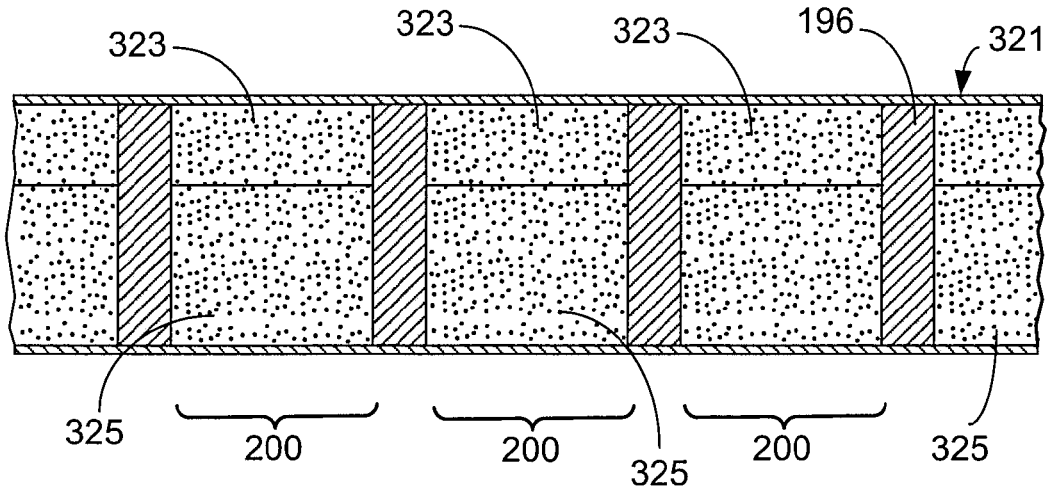
FIG. 12 is a cross-sectional view of an embodiment of a plate.

In other embodiments, channel(s) 200 can be filled with neutron-sensitive particles and neutron-insensitive particles. Referring to FIG. 12, channels 200 are filled near input side 321 with neutron-sensitive particles 323 and neutron-insensitive particles 325. Neutron-sensitive particles 323 can be generally the same as particles 145 and/or 184; and neutron-insensitive particles 325, can be, for example, lead glass spheres, fibers, or shards as described above. Neutron-sensitive particles 323 can reduce reverse ion flow, and neutron-insensitive particles 325 can propagate an electron cascade through channels 200.

Particles 323 and 325 can fill an entire channel 200, or a portion of the channel, e.g., less than about 100%, 90%, 80%, 70%, 60%, 50%, 40%, 30%, 20% or 10% of the length of the channel, and/or greater than about 0%, 10%, 20%, 30%, 40%, 50%, 60%, 70%, 80% or 90% of the length of the channel. Particles 323 make up a portion of the combination of particles 323 and 325, e.g., less than about 100%, 90%, 80%, 70%, 60%, 50%, 40%, 30%, 20% or 10%, and/or greater than about 0%, 10%, 20%, 30%, 40%, 50%, 60%, 70%, 80% or 90%.

For all embodiments, an external layer of neutron-sensitive material 147 may cover the input surface or front face of a multiplier. The thickness of material 147 can be a function of the neutron sensitive material, and can be nominally in the escape range of a neutron-induced particle or less, e.g., to enhance the efficiency of the multiplier. For example, if material 147 includes $^{10}B$ metal, then the thickness can be approximately 4 microns. The external layer may have a thickness greater than the escape range of the neutron-induced particles. The external layer may or may not be bonded to the top of the device, but the external layer can be within an evacuated volume of the multiplier. The top side of the external layer need not be in vacuum, e.g., only the side of the layer facing the device is in vacuum. The spacing between the external layer and the top of the multiplier is preferably relatively low, e.g., minimized, to reduce the spread of neutron-induced particles across the face of the multiplier. The neutron-induced particles from the external layer that impinge upon the multiplier can create electron cascades. The neutron-induced particles from the external layer can enhance the efficiency of the device.

In other embodiments, the external layer includes a neutron moderator material that creates a reduced number of neutron-induced conversion reactions. The neutron moderator material can slow the neutrons by removing energy through interactions that do not absorb the neutron, i.e., moderation. As a result, the neutrons are preserved and can interact as relatively low energy neutrons in a multiplier. Slowing the neutrons can increase the likelihood that the neutrons can interact and produce charged particles near the top surface of the multiplier or in the multiplier. Examples of neutron moderator materials include materials with high concentrations of hydrogen, e.g., Nylon™, or beryllium. The thickness of the external layer can be proportional to the energy of the incident neutron, e.g., the higher the energy of the neutron striking the external layer, the thicker the layer. The thickness can range from a few mm to a few cm.

In other embodiments, the external layer includes both a neutron-sensitive material layer and a neutron moderator material. The materials can be combined, e.g., layered and/or intimately mixed. The thickness of the layer can be such that the emission of particles from the layer into a device is maximized.

In other embodiments, structural support, such as support 116, can be attached to plates of electron multipliers to increase the durability and strength of the multipliers.

In some embodiments, particles include a core including lead (Pb) for enhanced hard X-ray detection. For X-ray energies greater than about 10 keV, an X-ray photon can interact with lead atoms in the bulk of the particle and can release photoelectrons. The primary electrons can generate low energy (e.g., <50 eV) secondary electrons, which may escape the particle and initiate electron avalanches within a detector. Particles having a core including lead can be modified as described above. For example, the particles can be spheres, shards, or fibers, such as similar to fibers 22, particles 145, or particles 184 having layer 192. The lead-containing particles can be used in any of the embodiments of multipliers described above, and modified accordingly, e.g., having an external layer.

The following examples are illustrative and not intended to be limiting.

EXAMPLE 1

A 35 mm diameter detector was formed by the following procedures.

Eight grams of boron-enriched 50 micron diameter lead glass fibers (Mo-Sci, Rolla, Mo.) were cut to 0.5 inch in length, and mixed with a solution of deionized water and HCl (pH between 2 and 2.25). The mixture was filtered through a Buchner funnel, and the liquid was removed via vacuum, allowing the fibers to settle randomly on a filter paper in the Buchner funnel. Subsequently, collodion was diluted to 1%, and poured over the fibers. After the collodion wetted the fibers, most of the collodion solution was removed via vacuum, leaving a mat of fibers in the funnel.

The mat of fibers was removed from the funnel, and allowed to air dry for several hours. The mat was then heated in a furnace at 690° C. for 4 hours to remove the cellulose binder, and then at 675° C. for 4 hours to fuse the fibers into a plate. The plate was then reduced in hydrogen at 525° C. for 16 hours.

The plate was then electroplated with a layer of Nichrome 1500 Å thick.

EXAMPLE 2

The following example demonstrates that the plate of Example 1 is capable of operating as an electron multiplier.

The plate of Example 1 was placed between two metal electrodes, and mounted to an imaging tube with a phosphor screen. The tube was then placed into a vacuum system and pumped to a vacuum of $5\times10^{-6}$ torr or lower. The vacuum system was equipped with a small filament that can generate electrons to the front face of the plate. In addition, the system had a UV transmissive front window that allows an external UV source to excite the plate from outside the vacuum system, and an ion gauge capable of producing residual ions inside the vacuum system to excite the plate.

The front of the plate was set to a voltage of −1500 to −5000 V and the rear of the plate was grounded. The voltage on the phosphor screen was set at +5000V. The phosphor screen was observed by eye and a digital camera with no input signal and with various inputs.

With no input source, the phosphor screen was dark. The phosphor screen was also dark when electrons were used as the incident particles, but the voltage across the plate was 0. Increasing the voltage across the plate, and having an active electron source, the plate began to light up the phosphor screen at approximately 2000 V. Higher voltages made the screen brighter, up to a saturation point of the plate.

A metal sheet having known shaped holes was then placed over the front of the plate and the test rerun. The image viewed on the phosphor screen faithfully reproduced the shapes on the metal sheet.

A plate containing neutron sensitive materials was tested using the same configuration, but with neutrons as the incident particles. With no neutron flux, the screen was dark. When neutrons were allowed to strike the plate, the screen immediately lit up. Hydrogenous and cadmium metal phantoms with holes and various shaped openings, one that absorbs neutrons, was used to stop neutrons from striking the plate. The observations on the phosphor screen matched that of the phantoms.

Other embodiments are within the claims.

What is claimed is:

1. A method, comprising:

contacting an electron multiplier with incident particles, the electron multiplier comprising a structure comprising a plurality of interconnected fibers having electron-emissive surfaces, wherein the particles interact with the fibers to produce electrons that contact against the surfaces of other fibers.

2. The method of claim 1, wherein the fibers include a glass having lead.

3. The method of claim 1, wherein the fibers comprise a neutron-sensitive material.

4. The method of claim 3, wherein the neutron-sensitive material is selected from a group consisting of $^{6}$Li, $^{10}$B, $^{155}$Gd, and $^{157}$Gd in excess of their natural abundance.

5. The method of claim 1, wherein the fibers comprise a hydrogen-containing material.

6. The method of claim 1, wherein the fibers have a length to width aspect ratio of about 50:1 to about 3,000:1.

7. The method of claim 1, wherein the structure has a void volume percentage between about 25% and about 90%.

8. The method of claim 1, wherein the fibers have a first region having a first lead concentration, and a second region having a second lead concentration greater than the first lead concentration.

9. The method of claim 8, wherein the first region is between the second region and the surfaces of the fibers.

10. The method of claim 1, wherein the incident particles are selected from the group consisting of photons, atoms, molecules, electrons, ions, and neutrons.

11. A method, comprising:

contacting an electron multiplier with incident particles, the electron multiplier comprising a structure having an array of channels, and a plurality of interconnected particles in at least one channel, wherein the particles interact with the particles to produce electrons that contact against the surfaces of other particles.

12. The method of claim 11, wherein the particles fill a portion of the channel.

13. The method of claim 11, wherein the structure comprises a glass having lead.

14. The method of claim 11, wherein the particles comprise fibers.

15. The method of claim 11, wherein the particles comprise spheres.

16. The method of claim 11, wherein the particles comprise shards.

17. The method of claim 11, wherein the particles have an electron-emissive surface layer.

18. The method of claim 11, wherein the channels have an electron-emissive surface layer.

19. The method of claim 11, wherein the particles comprise a neutron-sensitive material selected from a group consisting of $^{6}$Li, $^{10}$B, $^{155}$Gd, and $^{157}$Gd in excess of their natural abundance.

20. The method of claim 11, wherein the particles comprise a hydrogen-containing material.

21. The method of claim 11, wherein the particles comprise a core of the neutron-sensitive material.

22. The method of claim 21, wherein the core is substantially spherical.

23. The method of claim 21, wherein the channels have different widths along their lengths.

24. The method of claim 11, wherein the particles extend flushed to a surface of the structure.

25. The method of claim 11, wherein the particles further cover at least a portion of a surface of the structure different than a surface of the channel.

26. The method of claim 11, further comprising an electrode covering a portion of the structure and the particles.

27. The method of claim 11, wherein the incident particles are selected from the group consisting of photons, atoms, molecules, electrons, ions, and neutrons.

* * * * *

UNITED STATES PATENT AND TRADEMARK OFFICE

CERTIFICATE OF CORRECTION

PATENT NO. : 7,394,187 B2
APPLICATION NO. : 10/995833
DATED : July 1, 2008
INVENTOR(S) : P. Brian White et al.

It is certified that error appears in the above-identified patent and that said Letters Patent is hereby corrected as shown below:

In the specification

Col. 1, after line 10, please include the following paragraph:

-- STATEMENT REGARDING FEDERALLY SPONSORED RESEARCH OR DEVELOPMENT

This invention was made with government support under Argonne National Laboratory contract OF-00804. The government has certain rights in the invention. --

Signed and Sealed this
Twenty-sixth Day of April, 2016

Michelle K. Lee

Michelle K. Lee
*Director of the United States Patent and Trademark Office*